US012352479B2

(12) United States Patent
Low

(10) Patent No.: US 12,352,479 B2
(45) Date of Patent: Jul. 8, 2025

(54) METHOD AND AN APPARATUS FOR AT LEAST PARTIALLY DRAINING AN OPERATING SYSTEM

(71) Applicant: Mexichem Fluor S.A. de C.V., San Luis Potosi (MX)

(72) Inventor: Robert Low, Runcorn (GB)

(73) Assignee: MEXICHEM FLUOR S.A. DE C.V., San Luis Potosi (MX)

( * ) Notice: Subject to any disclaimer, the term of this patent is extended or adjusted under 35 U.S.C. 154(b) by 235 days.

(21) Appl. No.: 17/630,245

(22) PCT Filed: Jul. 27, 2020

(86) PCT No.: PCT/GB2020/051798
§ 371 (c)(1),
(2) Date: Jan. 26, 2022

(87) PCT Pub. No.: WO2021/019227
PCT Pub. Date: Feb. 4, 2021

(65) Prior Publication Data

US 2022/0282895 A1 Sep. 8, 2022

(30) Foreign Application Priority Data

Jul. 30, 2019 (GB) ..... 1910839

(51) Int. Cl.
*F25B 45/00* (2006.01)
*F25B 9/00* (2006.01)

(52) U.S. Cl.
CPC ..... *F25B 45/00* (2013.01); *F25B 9/008* (2013.01); *F25B 2345/002* (2013.01)

(58) Field of Classification Search
CPC .... F25B 45/00; F25B 9/008; F25B 2345/002; C09K 5/045
See application file for complete search history.

(56) References Cited

U.S. PATENT DOCUMENTS

| | | | | |
|---|---|---|---|---|
| 4,984,431 | A | 1/1991 | Mount et al. | |
| 5,150,577 | A | 9/1992 | Mitchell et al. | |
| 5,425,242 | A | 6/1995 | Dunne et al. | |
| 5,667,560 | A | 9/1997 | Dunne | |
| 2017/0045276 | A1 | 2/2017 | Brauer et al. | |
| 2021/0179908 | A1* | 6/2021 | Low | F25B 9/008 |

FOREIGN PATENT DOCUMENTS

| | | | | |
|---|---|---|---|---|
| CN | 104745259 | B | | 9/2018 |
| EP | 1014015 | A1 | | 6/2000 |
| JP | H07-139855 | A | | 6/1995 |
| JP | 2009-062471 | A | | 3/2009 |
| JP | 2011116822 | A | * | 6/2011 |
| WO | WO 2018/179089 | A1 | | 10/2018 |

OTHER PUBLICATIONS

PCT International Search Report for corresponding PCT Application No. PCT/GB2020/051798, mailed Oct. 30, 2020.
PCT Written Opinion of the International Searching Authority for corresponding PCT Application No. PCT/GB2020/051798, mailed Oct. 30, 2020.
Office Action issued in corresponding Chinese Patent Application No. 202080053116.5, dated Sep. 22, 2023, 11 pgs.
Office Action issued in corresponding Japanese Patent Application No. 2022-504274, dated May 1, 2024, 12 pgs, with English translation.

* cited by examiner

*Primary Examiner* — Ana M Vazquez
(74) *Attorney, Agent, or Firm* — Crowell & Moring LLP

(57) ABSTRACT

A method for at least partially draining an operating system, which contains a working fluid including carbon dioxide (R744) and a halogenated hydrocarbon. The method includes transferring the working fluid to a target container, from the operating system, wherein the working fluid is contacted with an absorptive bed. The working fluid may include between 10% and 35% by weight of halogenated hydrocarbon. The method may include an absorptive bed treatment step prior to the contacting step.

23 Claims, No Drawings

METHOD AND AN APPARATUS FOR AT LEAST PARTIALLY DRAINING AN OPERATING SYSTEM

CROSS-REFERENCE TO RELATED APPLICATIONS

This application is the U.S. National Stage application of PCT application no. PCT/GB2020/051798, filed on Jul. 27, 2020, titled A METHOD AND AN APPARATUS FOR AT LEAST PARTIALLY DRAINING AN OPERATING SYSTEM, designating the United States, and which claims priority to Great Britain application no. 1910839.8, filed on Jul. 30, 2019, the contents of which are each incorporated herein by reference in their entirety.

The present invention relates to a method for at least partially draining an operating system, which contains a working fluid.

Refrigeration systems are commonplace. Examples of refrigeration systems include refrigerated storage containers, as may be found in supermarkets, for containing foodstuffs or other materials, which need to be kept in a cooled/frozen state, to prevent/delay spoiling before sale.

Such refrigeration systems typically comprise a working fluid, which, in conjunction with a refrigeration/air conditioning unit, provides the desired cooling effect. The working fluids typically comprise hydrocarbons, carbon dioxide, ammonia and halogenated (chloro- and/or fluoro-) hydrocarbons. Often the working fluid comprises a mixture of two of more agents.

There are occasions when the working fluid has to be removed from the refrigeration system. Such removal may be occasioned by normal servicing, wherein the fluid has to be replaced; either following a scheduled servicing regime or due to degradation of the fluid with use. Other reasons for removal arise when the refrigeration system is being taken out of service.

Since many of the working fluids are potentially harmful for one or more issues including; toxicity, flammability and issues with global warming/ozone depletion there is a need for the fluid to be safely removed; both to ensure the safety of the removal operator and the prevention of discharge of potentially harmful chemicals into the atmosphere. Safe removal of the working fluid and transfer of same to a storage vessel achieve these aims. Further such removal is useful in that working fluid can be reused after removal, such as in a second refrigeration system.

Conventional recovery equipment for halocarbon refrigerants operates by a combination of liquid recovery followed by vapour recovery.

For the liquid recovery stage, the refrigerant is removed from the system as a liquid and transferred into a storage vessel.

For the vapour recovery stage, vapour is pumped out of the system then compressed and condensed in a small condenser heat exchanger, forming part of the recovery apparatus. The condensed refrigerant is then returned to a recovery cylinder for re-use or disposal. The condenser may be cooled by ambient air or a small onboard refrigeration loop in the recovery unit may be used. The compressor of the refrigeration system may be used to assist this pump-down process, or the vapour can be extracted and then compressed by a dedicated compressor forming part of the recovery unit.

Removal of the working fluid is made more complex when the working fluid comprises a mixture of two of more agents. The complexity arises since at the time of removal the specification of the working fluid has typically been altered from when it was applied meaning that reuse is not straightforward. Additionally, there may be a desire for reuse of certain components of the working fluid, rather than the admixture, requiring separation of the working fluid. These complications may lead to improper working fluid discharge, rather than the addressing of the issues. This is a particular issue when one of the components of the admixture comprises a halogenated hydrocarbon, the release of which into the atmosphere is highly regulated and one of the components of the admixture comprises an agent, for which the release of which into the atmosphere is less/un-regulated (such as carbon dioxide).

It is an object of the present invention to obviate or mitigate the issues described above.

According to a first aspect of the invention there is provided a method for at least partially draining an operating system, which contains a working fluid (comprising carbon dioxide (R744) and a halogenated hydrocarbon), the method comprising transferring the working fluid from the operating system to a target container, wherein the working fluid is contacted with an absorptive bed.

The method of the invention has been found to be surprisingly effective in the removal of working fluids comprising an admixture of carbon dioxide (R744) and a halogenated hydrocarbon. Using the method of the invention it is possible to at least recover the halogenated component of the admixture for re-use or disposal.

Generally, the operating system comprises a vapour-compression cycle for air-conditioning, heat pumping or refrigeration. A preferred example of such a system is a medium-temperature refrigeration system. Hence the preferred working fluid comprises a refrigerant.

The working fluid may be contacted with the absorptive bed more than once.

In the method the composition may be contacted with two or more absorptive beds. In such case the beds may be the same or different. Where the beds are different one bed may be for absorption of the halogenated hydrocarbon and a second bed may be for the absorption of the carbon dioxide.

Generally, the contacting step is performed, at least in part, at a temperature of from about 0° C. to about 200° C., more preferably at a temperature of from about 20° C. to about 100° C., more preferably at a temperature from about 20° C. to about 60° C., preferably at a temperature of about 40° C.

Generally, the contacting step is conducted at a pressure of from about 0.1 to 50 Bara.

The absorptive bed may require treatment prior to the contacting step. The treatment step preferably comprises a heat treatment step comprising heating the bed so as to remove adsorbed gases, optionally followed by a cooling step to reduce the temperature of the solid adsorptive material and thus improve its capacity for uptake of fluid.

The absorptive bed treatment step may comprise an exposure step comprising exposing the adsorbent to one or more inert gases, preferably $N_2$ or one or more noble gases.

The absorptive bed treatment step (prior to the contacting step) may be operated under a full/partial vacuum.

The absorptive bed may be dried before use.

The absorptive bed may require treatment after the contacting step. It will be appreciated that the absorptive material may need treatment following the use of the apparatus in draining an operating system. Such treatment may be necessitated to regenerate the absorptive material and extract the absorbed material therefrom.

The regeneration of the absorptive material may comprise exposing the absorptive material to elevated temperature and/or reduced pressure or vacuum. In this regeneration preferably the released material is captured.

The method of the invention is suitable for liquid and/or vapour recovery.

Generally, the working fluid comprises a halogenated refrigerant, comprising at least R-32 (difluoromethane). Preferably the working fluid has the composition comprising: (a) from about 10 percent to about 35 percent by weight of R-32; (b) from about 65 percent to about 90 percent by weight of R744 (carbon dioxide), based on the weight of components (a) to (b).

Optionally the halogenated refrigerant fluid comprises amounts of other refrigerants, such as R-1132a (1,1-difluoroethene), R-1123 (trifluoroethene), R-134a (1,1,1,2-tetrafluoroethane), R-152a (1,1-difluoroethane), R-125 (pentafluoroethane), R-227ea (1,1,1,2,3,3,3-heptafluoropropane), R-1234ze(E) (trans-1,1,1,3-tetrafluoropropene), R-1234yf (2,3,3,3-tetrafluoropropene), R-13I1 (iodotrifluoromethane) or mixtures of one or more of these. Preferably the total proportion of halogenated refrigerant in the mixture is about 10 to 35% by weight of the total composition.

The refrigerant may also comprise minor quantities of one or more hydrocarbons selected from: propane (R-290); propene (R-1270); isobutane (R-600a); or n-butane (R-600), wherein the proportion of hydrocarbon in the total mixture is less than about 5% by weight.

According to a second aspect of the invention there is provided an apparatus for at least partially draining an operating system, which contains a working fluid (comprising carbon dioxide (R744) and a halogenated hydrocarbon), wherein the apparatus is suitable for connection with the operating system via a conduit, the apparatus comprising a) An absorptive bed, and b) A storage container.

It will be appreciated that features of the first aspect of the invention shall be taken to apply mutatis mutandis to the second aspect of the invention.

Preferably the absorptive bed is upstream of the storage container.

Preferably the absorptive bed comprises an absorptive material. Generally, the absorptive material comprises openings which have a size across their largest dimension of from about 2 Å to about 12 Å.

Generally, the absorptive material comprises an aluminium-containing adsorbent, activated carbon, or a mixture thereof. Preferably the absorptive material comprises alumina or aluminosilicate; most preferably the absorptive material comprises aluminosilicate.

Preferably the aluminosilicate comprises a molecular sieve (zeolite) having pore sizes in the range 2 to 12 Angstroms, e.g. about 3 Å to about 6 Å, such as having a mean pore size of about 3 Å or about 4 Å.

According to a third aspect of the invention there is provided the use of an apparatus according to the second aspect of the invention in performing a method according to the first aspect of the invention.

The invention claimed is:

1. A method for at least partially draining an operating system, which contains a working fluid composition comprising carbon dioxide (R744) and a halogenated hydrocarbon, the method comprising:

transferring the working fluid from the operating system to a target container; and contacting the working fluid with an absorptive bed before the working fluid is received by the target container, wherein a total proportion of the halogenated hydrocarbon in the working fluid is about 10% to 35% by weight of the total working fluid, wherein the contacting step is performed, at least in part, at a temperature of from about 60° C. to about 200° C.

2. The method of claim 1, wherein the operating system is a refrigeration system.

3. The method according to claim 1, wherein the operating system is a medium-temperature refrigeration system.

4. The method according to claim 1, wherein the working fluid is contacted with the same absorptive bed more than once.

5. The method according to claim 1, wherein the working fluid is contacted with two or more absorptive beds.

6. The method according to claim 1, wherein the contacting step is conducted at a pressure of from about 0.1 to 50 Bara.

7. The method according to claim 1, comprising an absorptive bed treatment step prior to the contacting step.

8. The method according to claim 7 wherein the absorptive bed treatment step comprises a heat treatment step comprising heating the absorptive bed adsorbent to a maximum temperature of at least 150° C., or at least 200° C.

9. The method according to claim 8 wherein the heat treatment step comprises heating the absorptive bed to the maximum temperature at a rate of from 0° C./minute to 60° C./minute, or at a rate of from 20° C./minute to 40° C./minute.

10. The method according to claim 8 wherein the heat treatment step comprises maintaining the absorptive bed at or around the maximum temperature for a time of from 1 second to 1 hour.

11. The method according to claim 7, wherein the absorptive bed treatment step comprises an exposure step, comprising exposing the absorptive bed to one or more inert gases.

12. The method according to claim 7, wherein the absorptive bed treatment step comprises an exposure step comprising exposing the absorptive bed to vacuum.

13. The method according to claim 1, comprising an absorptive bed treatment step after the contacting step.

14. The method according to claim 13 wherein the absorptive bed treatment step after the contacting step comprises exposing the absorptive material in the absorptive bed to elevated temperature and/or vacuum.

15. The method according to claim 1, wherein the working fluid comprises R-32 (difluoromethane).

16. The method according to claim 15, wherein the working fluid comprises: (a) from about 10 percent to about 35 percent by weight of R-32; (b) from about 65 percent to about 90 percent by weight of R744 (carbon dioxide), based on the weight of components (a) to (b).

17. The method according to claim 1, comprising connecting the operating system via a conduit with an apparatus comprising the absorptive bed and the target container.

18. The method according to claim 1, wherein the absorptive bed comprises a first absorptive bed for absorption of the halogenated hydrocarbon and a second absorptive bed for absorption of the carbon dioxide.

19. The method according to claim 1, wherein the total proportion of the carbon dioxide in the working fluid is from about 65% to about 90% by weight of the total working fluid.

20. A method for at least partially draining an operating system, which contains a working fluid comprising carbon dioxide (R744) and a halogenated hydrocarbon, the method comprising:

connecting the operating system via a conduit to an apparatus comprising an absorptive bed in fluid communication with a storage container;

contacting the working fluid with an absorptive material in the absorptive bed at a temperature of from about 60° C. to about 200° C.;

exposing the absorptive material in the absorptive bed to elevated temperature and/or vacuum to desorb the halogenated hydrogen from the absorptive material; and transferring the desorbed halogenated hydrogen to the storage container.

21. The method according to claim 20 wherein the absorptive material comprises openings which have a size across their largest dimension of from about 2 Å to about 12 Å.

22. The method according to claim 20 wherein the absorptive material comprises an aluminium-containing adsorbent, activated carbon, or a mixture thereof.

23. The method according to claim 22 wherein the absorptive material comprises a molecular sieve having pore sizes in the range 2 to 12 Angstroms.

* * * * *